US011702922B2

(12) United States Patent
Ambrus et al.

(10) Patent No.: US 11,702,922 B2
(45) Date of Patent: Jul. 18, 2023

(54) OPTIMIZATION OF DRILLING OPERATIONS USING DRILLING CONES

(71) Applicant: Intellicess, Inc., Austin, TX (US)

(72) Inventors: Adrian Marius Ambrus, Stavanger (NO); Pradeepkumar Ashok, Austin, TX (US)

(73) Assignee: Intellicess, Inc., Austin, TX (US)

( * ) Notice: Subject to any disclaimer, the term of this patent is extended or adjusted under 35 U.S.C. 154(b) by 0 days.

(21) Appl. No.: 15/908,451

(22) Filed: Feb. 28, 2018

(65) Prior Publication Data

US 2022/0275718 A1 Sep. 1, 2022

Related U.S. Application Data

(60) Provisional application No. 62/528,654, filed on Jul. 5, 2017, provisional application No. 62/464,472, filed on Feb. 28, 2017.

(51) Int. Cl.
*E21B 44/04* (2006.01)
*E21B 45/00* (2006.01)

(52) U.S. Cl.
CPC ..... *E21B 44/04* (2013.01); *E21B 45/00* (2013.01); *E21B 2200/20* (2020.05); *E21B 2200/22* (2020.05)

(58) Field of Classification Search
CPC ..... E21B 44/00; E21B 44/02; E21B 44/04; E21B 45/00; E21B 2200/20; E21B 2200/22
See application file for complete search history.

(56) References Cited

U.S. PATENT DOCUMENTS

| | | | | |
|---|---|---|---|---|
| 7,861,800 | B2 * | 1/2011 | Chapman | G06N 7/005 175/24 |
| 2012/0118637 | A1 * | 5/2012 | Wang | E21B 44/00 700/29 |
| 2014/0277752 | A1 * | 9/2014 | Chang | E21B 44/00 700/275 |
| 2016/0333673 | A1 * | 11/2016 | Anno | G05B 15/02 |

* cited by examiner

*Primary Examiner* — Brad Harcourt
(74) *Attorney, Agent, or Firm* — Avek IP, LLC

(57) ABSTRACT

Drilling operations may be monitored to detect and quantify potential drilling dysfunctions. Using a Bayesian network, potential improvements to drilling operation may be made depending upon the type of dysfunction detected. Suggestions for improved drilling performance may comprise increasing, decreasing, or maintaining one or both of RPM and weight on bit. Suggestions may be presented to an operator as a cone having an apex at the current RPM and weight on bit drilling parameters, with suggestions for modifications to one or both of the RPM and weight on bit corresponding to a cone extending from that apex.

16 Claims, 13 Drawing Sheets

740

760

900

1000

1100

OPTIMIZATION OF DRILLING OPERATIONS USING DRILLING CONES

CROSS-REFERENCE TO RELATED APPLICATIONS

This application claims the benefit of U.S. provisional patent application No. 62/464,472, entitled "OPTIMIZATION OF DRILLING OPERATIONS," filed on Feb. 28, 2017, and which is incorporated herein by reference. This application also claims the benefit of U.S. provisional patent application No. 62/528,654, entitled "OPTIMIZATION OF DRILLING OPERATIONS USING DRILLING CONES," filed on Jul. 5, 2017, and which is incorporated herein by reference.

FIELD OF INVENTION

The present invention relates to drilling systems and methods. More particularly, the present invention relates to systems and methods for monitoring drilling operations and providing recommendations for more efficient, safe, and/or effective drilling.

BACKGROUND AND DESCRIPTION OF THE RELATED ART

Drilling operations for oil and gas are often inefficient. Many industrial processes have been made more efficient by collecting data through sensor measurements and analyzing the data obtained to identify operational changes that may be made to improve the efficiency of the process. Such an approach for drilling operations has been impeded, however. While drilling rig sensors may provide data that permits the efficiency of drilling operations to be improved and/or to identify faults in a drilling operation, the volume of data collected by the multiplicity of sensors available for a modern drilling rig can be too large to be effectively processed by a human drilling operator or even a typical software program. Moreover, the challenging physical environment and the nature of the sensors used may make measurements highly noisy and erratic (at best) or entirely missing or faulty (at worst).

SUMMARY OF THE INVENTION

Systems and methods in accordance with the present invention enable real time analysis of drilling operation sensor data to provide the driller with information needed to fine-tune drilling parameters, such as the top drive revolutions per minute (RPM), the weight on the drill bit, the differential pressure across the mud motor, and other relevant drilling parameters. Systems and methods in accordance with the present invention may consider uncertainty in the sensor data to increase the robustness of optimization suggestions. Systems and methods in accordance with the present invention may use a holistic Bayesian network model of the drilling rig operations to characterize drilling operations and/or to make recommendations to improve drilling operations. In further examples in accordance with the present invention, recommendations to improve drilling operations may be made to an operator, for example using a drilling cone to present suggestions for drilling parameter adjustment.

BRIEF DESCRIPTION OF THE SEVERAL VIEWS OF THE DRAWINGS

Examples of systems and methods in accordance with the present invention are described in conjunction with the attached drawings, wherein.

DETAILED DESCRIPTION

Figure 1:
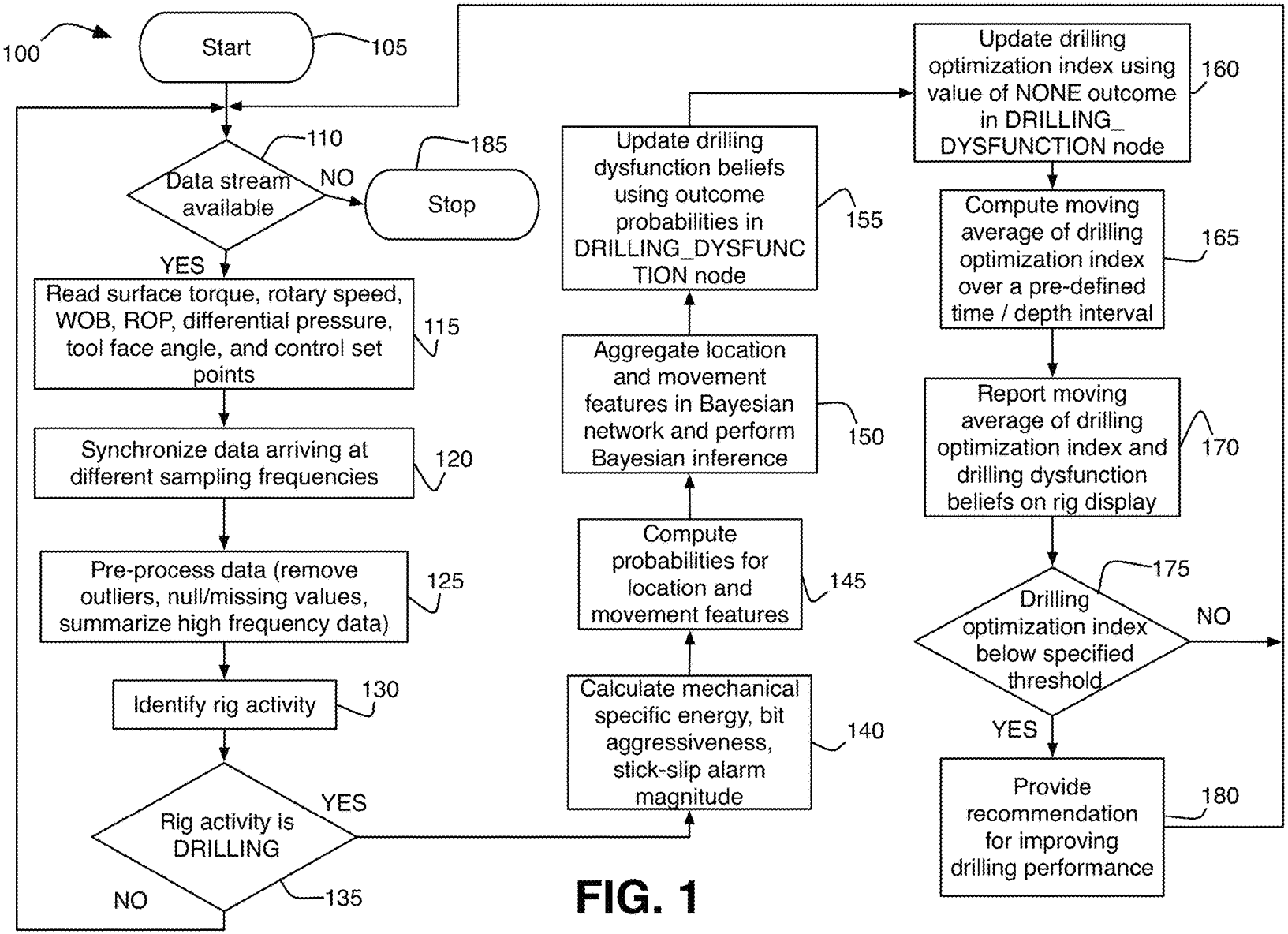
FIG. 1 illustrates an exemplary method for optimizing drilling performance in accordance with the present invention.

FIG. 1 depicts an example of a method 100 in accordance with the present invention for analyzing drilling performance. Method 100 may start 105 and proceed to step 110 to determine whether a data stream is available. A data stream may comprise measurements made by a plurality of sensors measuring ongoing drilling operation parameters. If the conclusion of step 110 is that no data stream is available, method 100 may proceed to stop in step 185. If, however, the data stream is available in step 110, method 100 may proceed to step 115 to read surface torque, rotary speed, weight on bit (WOB), rate of penetration (ROP), differential pressure, toolface angle, and control set points. Method 100 may then proceed to step 120 to synchronize data arriving at different sampling frequencies. Step 120 may accommodate a situation where different rig sensors read and/or report data at different frequencies, thereby permitting the time synchronization of the sensor measurements to accurately depict the trends of the data collected by various sensors as a function of time.

Method 100 may then proceed to step 125 to preprocess the data collected from the sensors. Preprocessing step 125 may remove obvious data outliers, null or missing values from sensor readings, and/or to summarize high-frequency data to one or a few data points. High frequency data may occur, for example, when a particular sensor makes considerably more frequent readings/reports than other sensors.

Method 100 may then proceed to step 130 to identify rig activity. Method 100 may then proceed to step 135 and, if the rig activity is not drilling, method 100 may then return to step 110 to determine whether a drilling data stream is available. If, however, the outcome of step 135 is to determine that rig activity is drilling, method 100 may proceed to step 140. Step 140 may calculate the mechanical specific energy (MSE), bit aggressiveness, and/or stick slip alarm magnitude using the collected sensor readings. Method 100 may then proceed to step 145 to compute probabilities for a set of relevant location and movement features of the drilling rig. Method 100 may then proceed to step 150 to aggregate location and movement features in a holistic Bayesian network and perform a Bayesian inference using the probabilistic weights connecting various nodes in the Bayesian network model.

Method 100 may then proceed to step 155 to update drilling dysfunction beliefs using outcome probabilities produced by a drilling dysfunction node in the Bayesian network model, described more fully below. Method 100 may then proceed to step 160 to update drilling optimization indexes using the probabilistic outcome of the drilling dysfunction node corresponding to no dysfunction detected. Method 100 may then proceed to step 165 to compute a moving average of drilling optimization indexes over a predefined period of time or depth interval. Method 100 may then proceed to step 170 to report the averaged drilling optimization index and drilling dysfunction beliefs on a rig display for a rig operator. Method 100 may then proceed to step 175 to determine whether the drilling optimization index is below a specified threshold. If the conclusion of step 175 is that the optimization index is below the specified threshold, method 100 may proceed to step 185 to provide a recommendation for improving the drilling performance. This recommendation may be in the form of a suggested parameter change, such as increasing or decreasing the rotary speed, weight on bit, differential pressure set point, toolface angle, or a combination of these actions (for example, decreasing weight on bit while increasing rotary speed to avoid stick-slip). Alternatively/additionally, a recommendation may be made to engage or disengage an automatic control system, if available, such as an auto-driller, or a stick-slip mitigation system. If, on the other hand, the outcome of step 175 is to conclude that the drilling optimization index is not below the specified threshold, method 100 may return to step 110 to once again determine whether a new data stream is available and to repeat the entire process.

Figure 2:
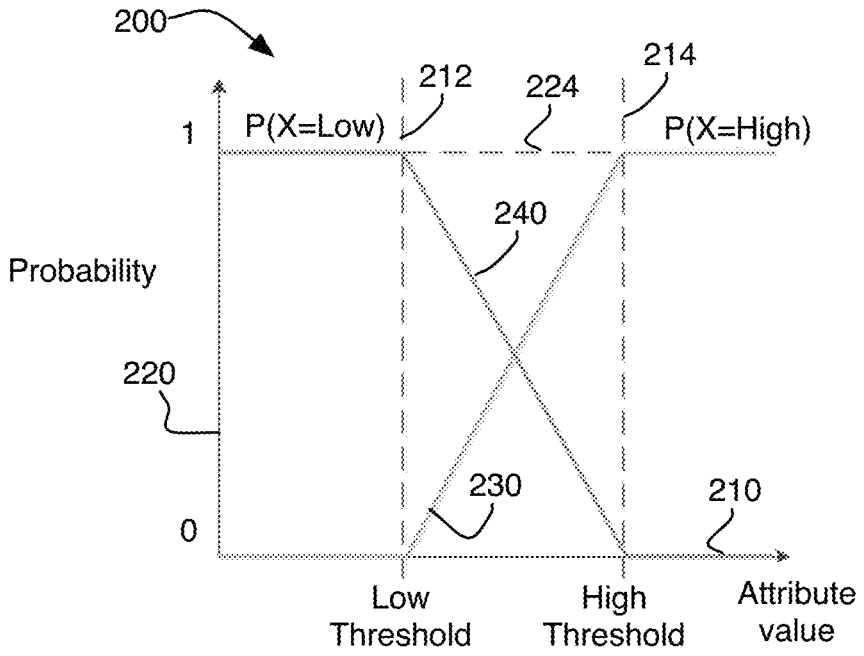
FIG. 2 illustrates an example of calculating location and movement features in accordance with the present invention.
Figure 3:
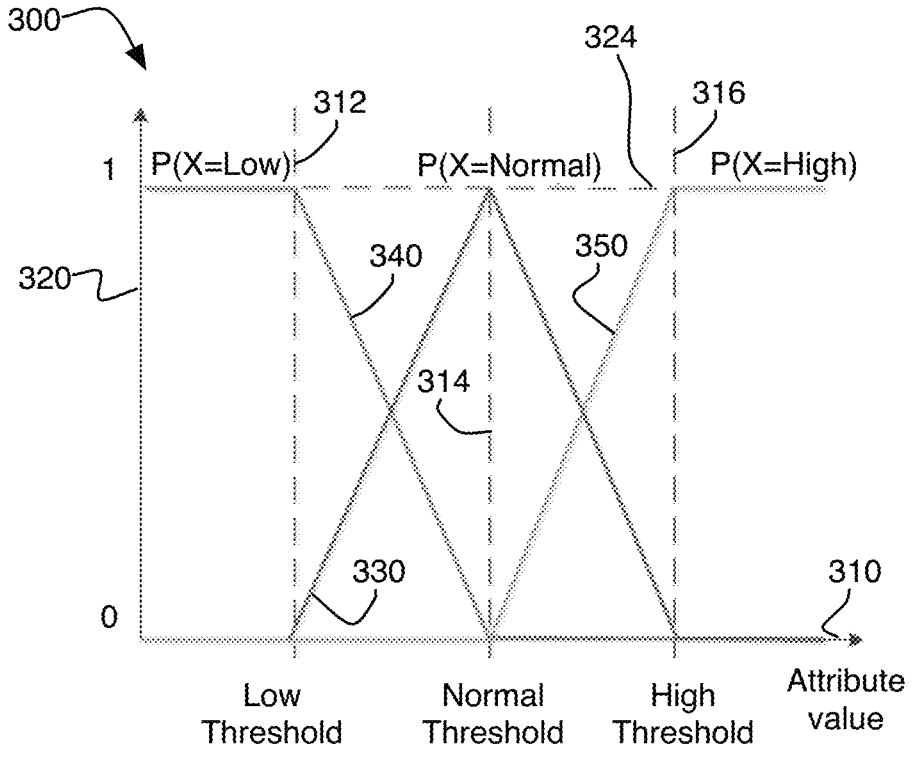
FIG. 3 illustrates a further example of calculating location and movement features in accordance with the present invention.
Figure 4:
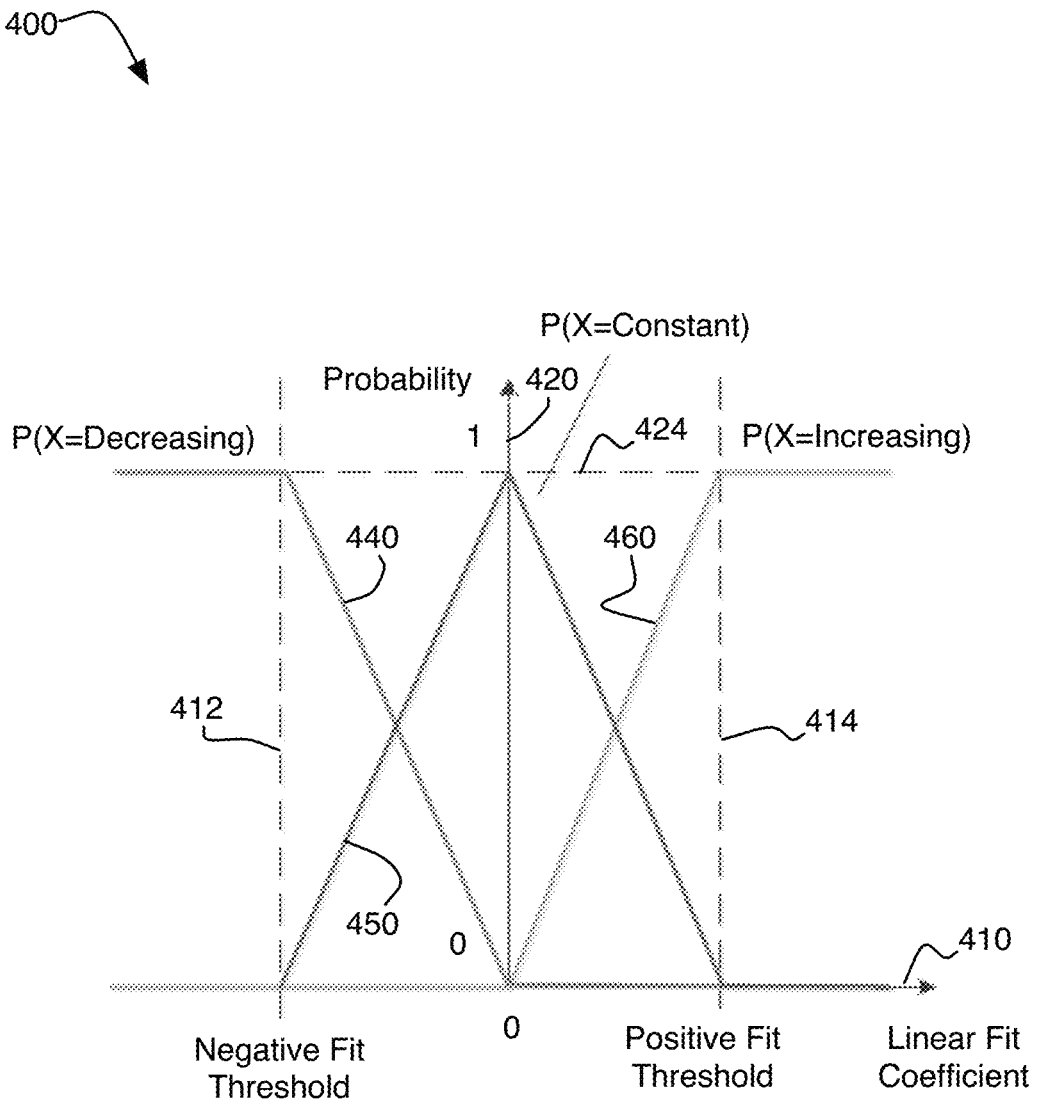
FIG. 4 illustrates yet a further example of calculating location and movement features in accordance with the present invention.

Referring now to FIGS. 2, 3, and 4, examples of calculating location and movement features in accordance with the present invention are illustrated. As shown in these examples, each feature outputs a probability value. For example, as depicted in FIG. 2, a probability may be determined for the location of an attribute value based upon a threshold range from a low threshold 212 to a high threshold 214. Probability 220 may range from zero to one 224. The attribute value depicted on the x-axis 210 may comprise a location, while in the example of FIG. 2 the y-axis 220 depicts a probability of the attribute actually being in that location. Exemplary probability functions 230 (ranging from low to high) and 240 (ranging from high to low) are illustrated. Meanwhile, the example depicted in FIG. 3 illustrates a normal threshold 314, a low threshold 312, and a high threshold 316 for a given measured attribute value. As in the example of FIG. 2, the attribute value depicted on the x-axis 310 may comprise a location while the y-axis 320 depicts a probability of the attribute actually being in that location, while exemplary probability functions 330, 340, 350 may range from zero 310 to one 324. Similarly, FIG. 4 depicts a movement feature with a probability depicted on the y-axis 420 for sensor attribute values depicted on the x-axis 410. In the example of FIG. 4, movement features may be classified using linear curve fitting performed over a moving window of values from a lower threshold 412 to a higher threshold 414 for attributes of interest. Exemplary probability functions 440, 450, 460 are shown ranging from zero 410 to one 424. A sensor attribute may provide a negative fit threshold and a positive fit threshold, with a linear fit coefficient used to determine the probability of the attribute of interest having an increasing, decreasing, or constant trend.

Figure 5A:
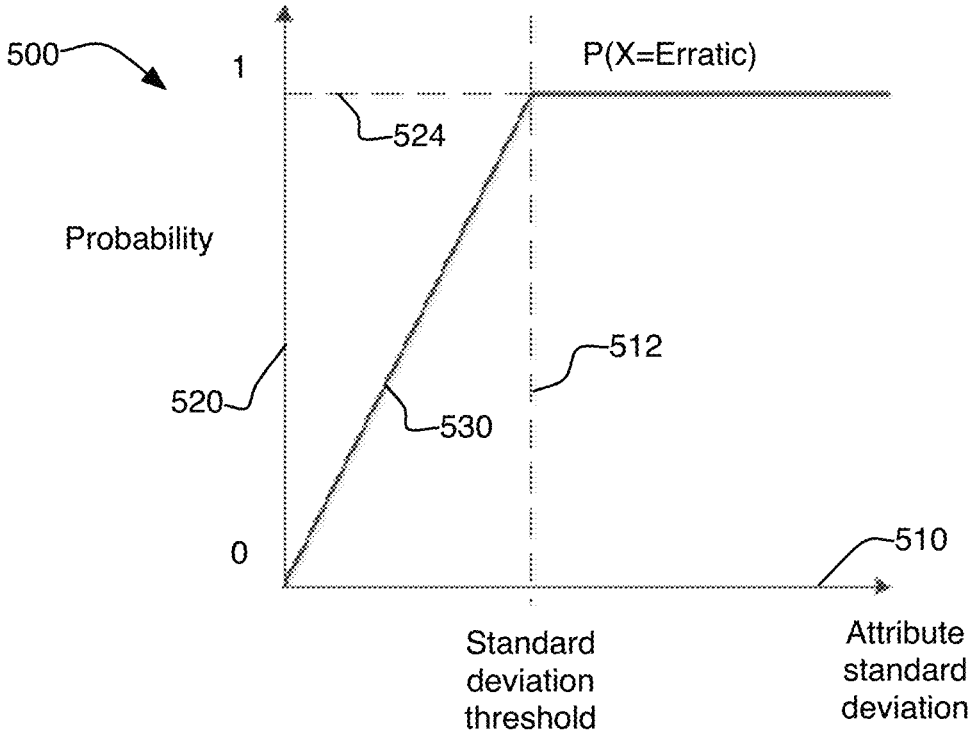
FIGS. 5A and 5B depict examples of probability functions for attributes monitored in accordance with the present invention.
Figure 5B:
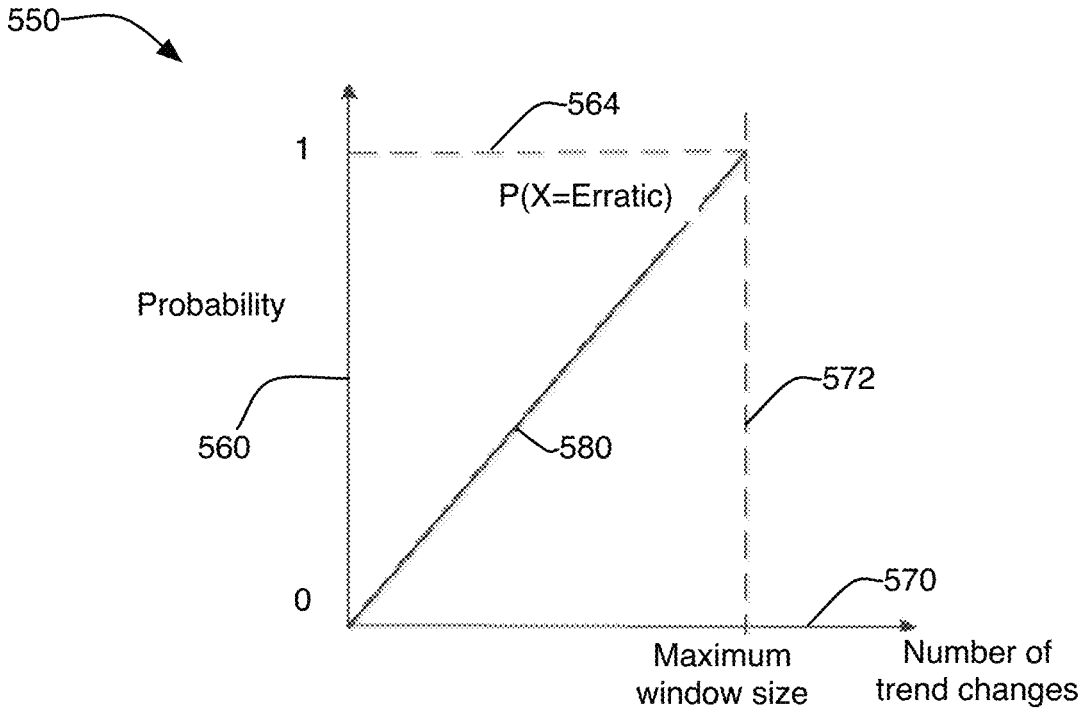
Figure 6A:
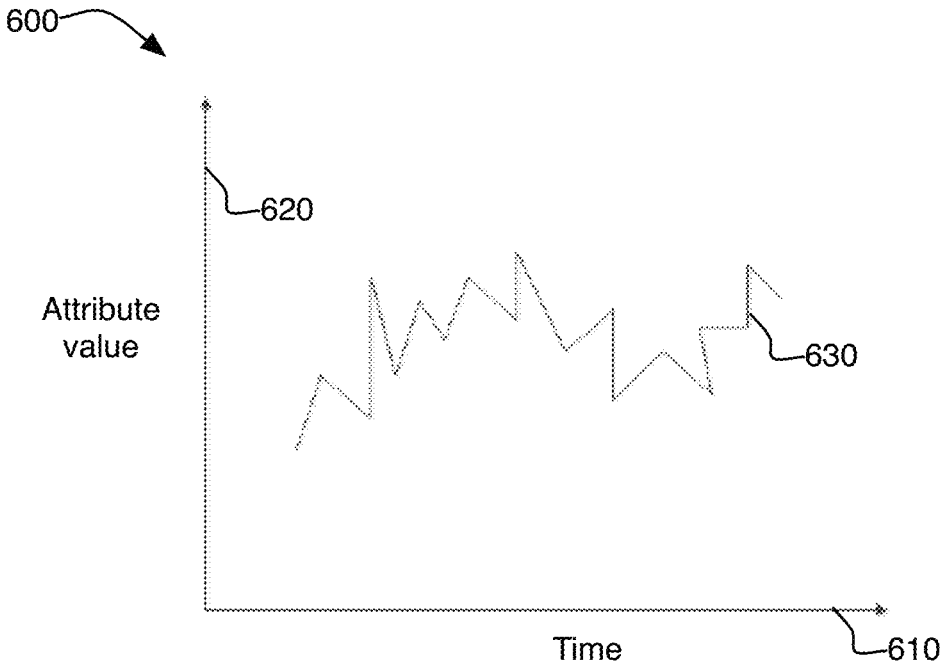
FIGS. 6A and 6B depict examples of attributes with different degrees of erraticity.
Figure 6B:
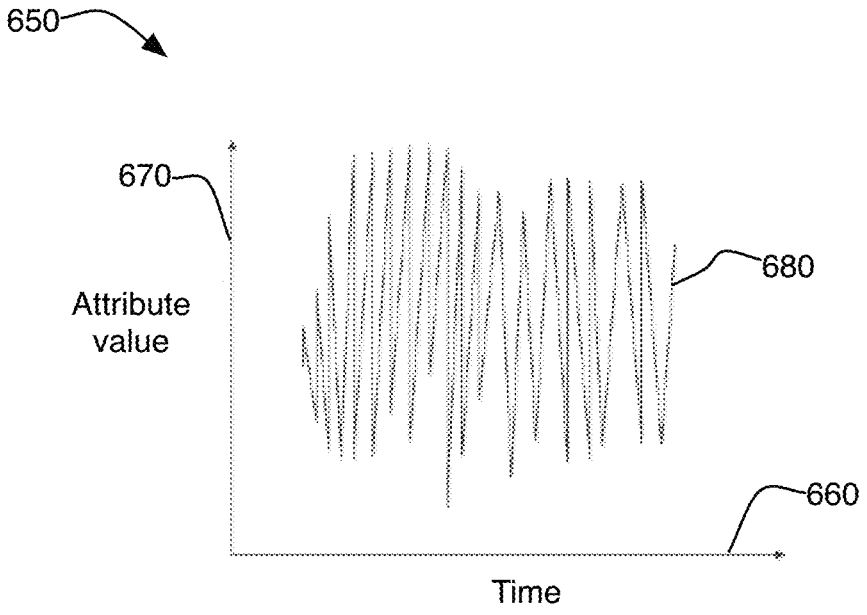

Movement features may also be analyzed by determining if a feature is erratic by looking at standard deviation of measurements of that feature and/or by identifying alternatingly increasing/decreasing trends for the measured value. FIG. 5A depicts a probability function based upon a standard deviation threshold defined for an attribute value. Meanwhile, FIG. 5B depicts an example where the erratic probability may be determined based upon the frequency of changes in trends from increasing to decreasing. FIG. 6A and FIG. 6B show examples of attributes with different degrees of erraticity.

Figure 7A:
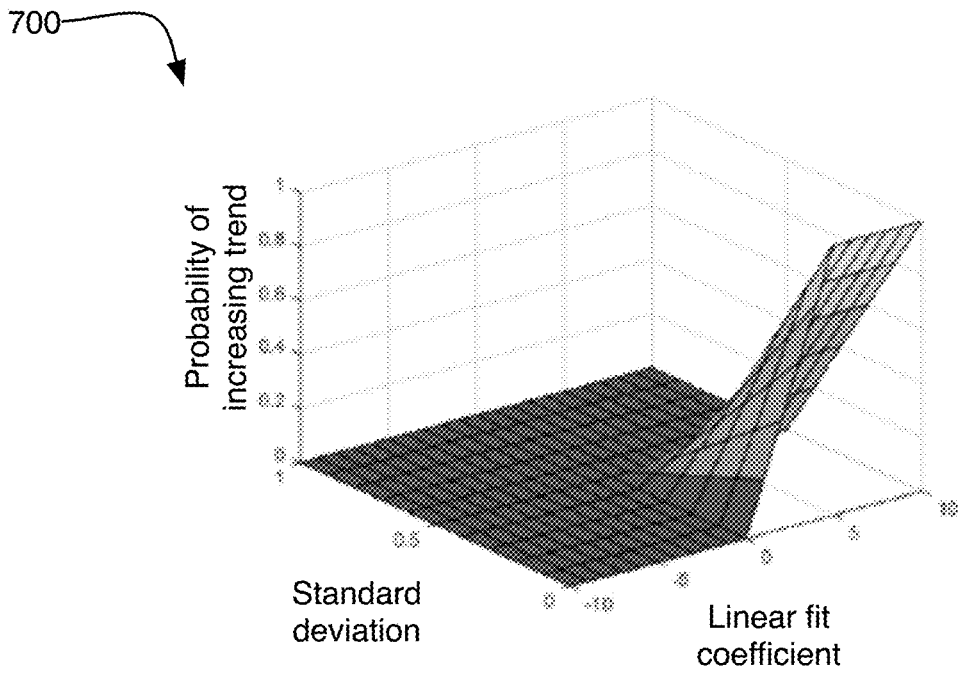
FIGS. 7A, 7B, 7C, and 7D illustrate examples of monitored drilling data trends depicted as three-dimensional surfaces in accordance with the present invention.
Figure 7B:
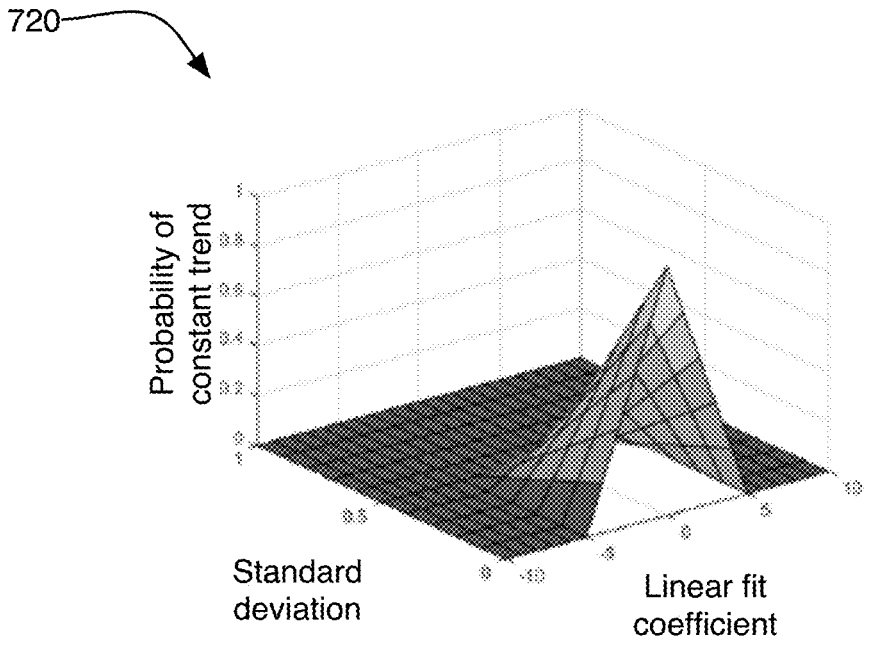
Figure 7C:
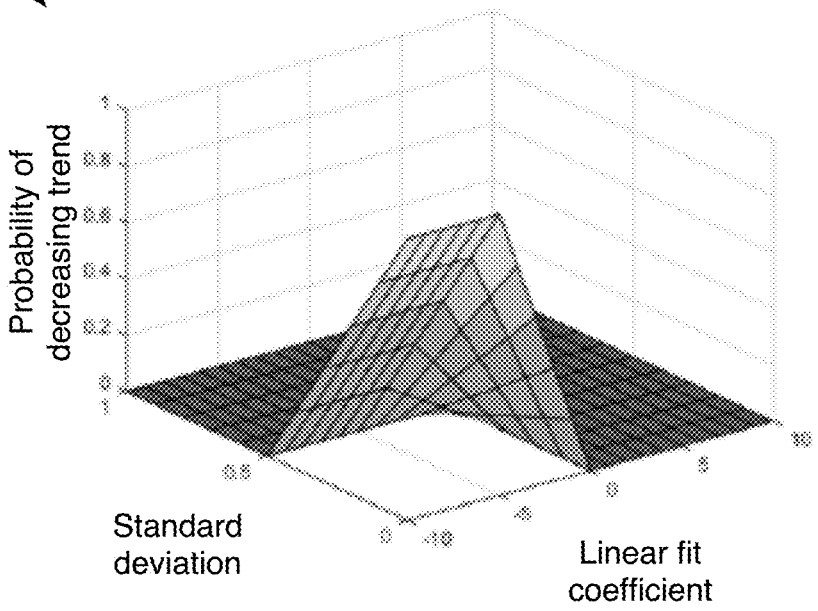
Figure 7D:
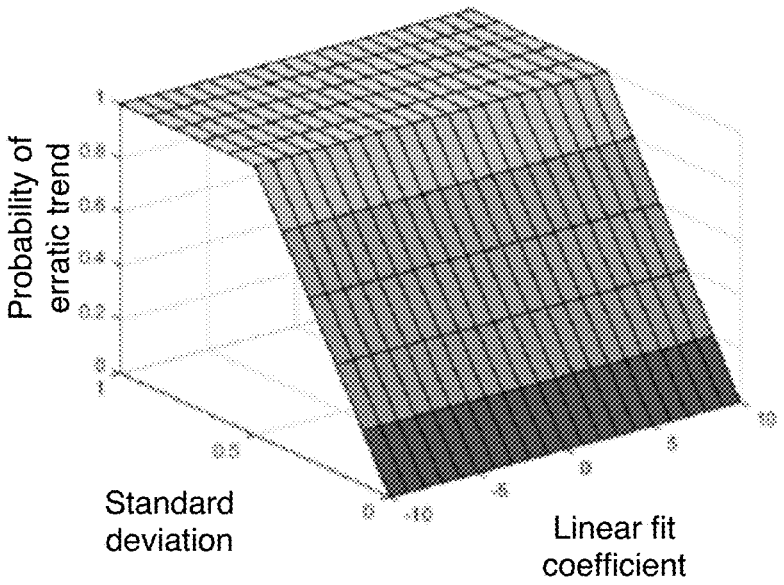

The mean trends in analyzed movement or other data may be combined with standard deviation variations of those measurements. Mean trends may comprise for example, whether the sensor measurements are increasing, decreasing or constant. Useful features such as MSE, bit aggressiveness may have highly erratic trends that indicate the presence of axial, torsional or lateral vibration. The resulting trends may be rendered as three-dimensional surfaces. Examples of such surfaces are depicted in FIG. 7A, FIG. 7B, FIG. 7C, and FIG. 7D. In the example of FIG. 7A, the x-axis and y-axis are the standard deviation of the measurement and the linear fit coefficient, while the z-axis is the probability of an increasing trend. In the example of FIG. 7B, the x-axis and y-axis are the standard deviation of the measurement and the linear fit coefficient, while the z-axis is the probability of a constant trend. In the example of FIG. 7C, the x-axis and y-axis are the standard deviation of the measurement and the linear fit coefficient, while the z-axis is the probability of a decreasing trend. In the example of FIG. 7D, the x-axis and y-axis are the standard deviation of the measurement and the linear fit coefficient, while the z-axis is the probability of an erratic trend.

Figure 8:
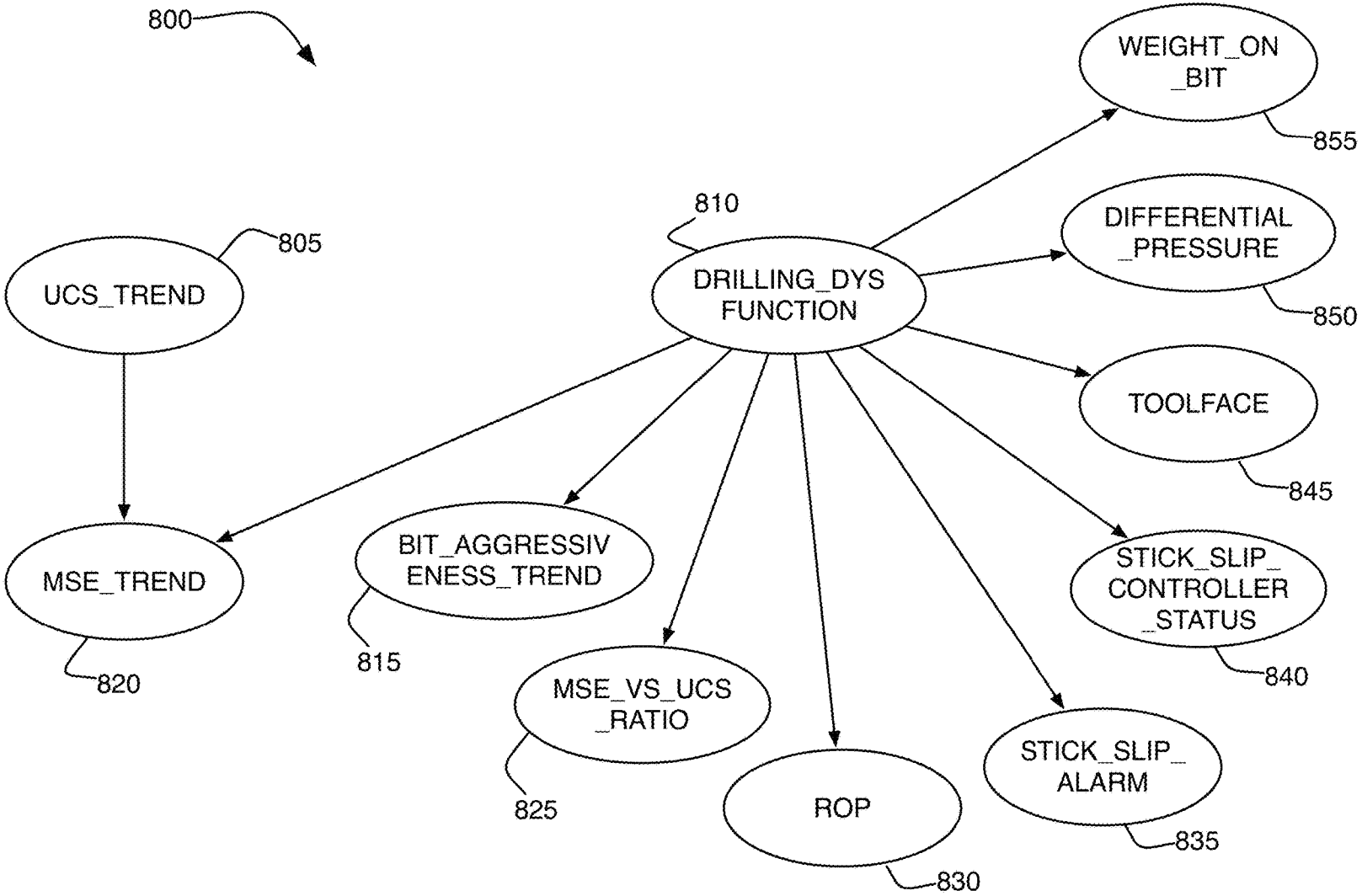
FIG. 8 illustrates an example of a Bayesian network model that may be used for drilling optimization index calculations in accordance with the present invention.

FIG. 8 depicts an example of a Bayesian network model that may be used for drilling optimization index calculations in accordance with the present invention. Bayesian network model 800 may comprise a plurality of nodes with probabilistically weighted interconnections between the nodes. Bayesian network model 800 may comprise UCS_TREND node 805, DRILLING_DYSFUNCTION node 810, BIT_AGGRESSIVENESS_TREND node 815, MSE_TREND node 820, MSE_VS_UCS_RATIO node 825, ROP node 830, STICK_SLIP_ALARM node 835, STICK_SLIP_CONTROLLER_STATUS node 840, TOOLFACE node 845, DIFFERENTIAL_PRESSURE node 850, and WEIGHT_ON_BIT node 855. UCS_TREND node 805 is related to the unconfined compressive strength (UCS) of the formation being drilled, and may have four possible outcomes: constant, increasing, decreasing, and unknown. DRILLING_DYSFUNCTION node 810 may have possible outcomes of: none (no dysfunction present), bit balling, bit bounce, stick-slip, whirl, mud motor failure, auto-driller dysfunction, stick-slip controller dysfunction, geosteering dysfunction, and low rate of penetration. DRILLING_DYSFUNCTION node 810 outcome may be associated with a prior and posterior probability value. The prior values can be determined based on the frequency of occurrence for each type of dysfunction, while the posterior probabilities are the result of the Bayesian inference performed in light of the available data. BIT_AGGRESSIVENESS_TREND node 815 is related to the calculated bit aggressiveness and its trend over a time window of interest, and may have five possible outcomes: constant, increasing, decreasing, erratic, and unknown. MSE_TREND node 820 refers to the calculated MSE and its trend over a time window of interest and may comprise five possible outcomes: constant, increasing, decreasing, erratic, and unknown. MSE_VS_UCS_RATIO node 825 refers to the effective ratio of the mechanical specific energy to the unconfined compressive strength of the formation and may comprise three possible outcomes: low, high, and unknown. ROP node 830 is related to the instantaneous rate of penetration and its location with respect to a set of pre-defined thresholds, and may comprise four possible outcomes: low, normal, optimal, and unknown. STICK_SLIP_ALARM node 835 is a diagnostic feature related to the presence of stick-slip vibration and may comprise three possible outcomes relative to predefined thresholds: low, high, and unknown. STICK_SLIP_CONTROLLER_STATUS node 840 may comprise three possible outcomes based on whether a control system for stick-slip mitigation is in use: on, off, and not available. TOOLFACE node 845 is related to the ability to steer the drill bit with respect to a geological target in directional drilling operations (as indicated by the toolface angle), and may comprise three possible outcomes: on target, off target, and unknown. DIFFERENTIAL_PRESSURE node 850 refers to the degree to which the measured differential pressure follows the target (set point) value in the case of an auto-driller operation and may comprise four possible outcomes: at set point, above set point, below set point, and unknown. WEIGHT_ON_BIT node 855 refers to the degree to which the measured weight on bit follows the target value in the case of an auto-driller operation and may comprise four possible outcomes: at set point, above set point, below set point, and unknown. Each of nodes 815, 820, 825, 830, 835, 840, 845, 850, 855 may be assigned a conditional probability table representing a set of probabilistic weights connecting their respective outcomes to their parent nodes (805 and/or 810). These probabilistic weights may be assigned through expert knowledge, heuristics, and/or machine learning algorithms which compute the conditional probability tables based on data sets containing various drilling dysfunctions.

Figure 9:
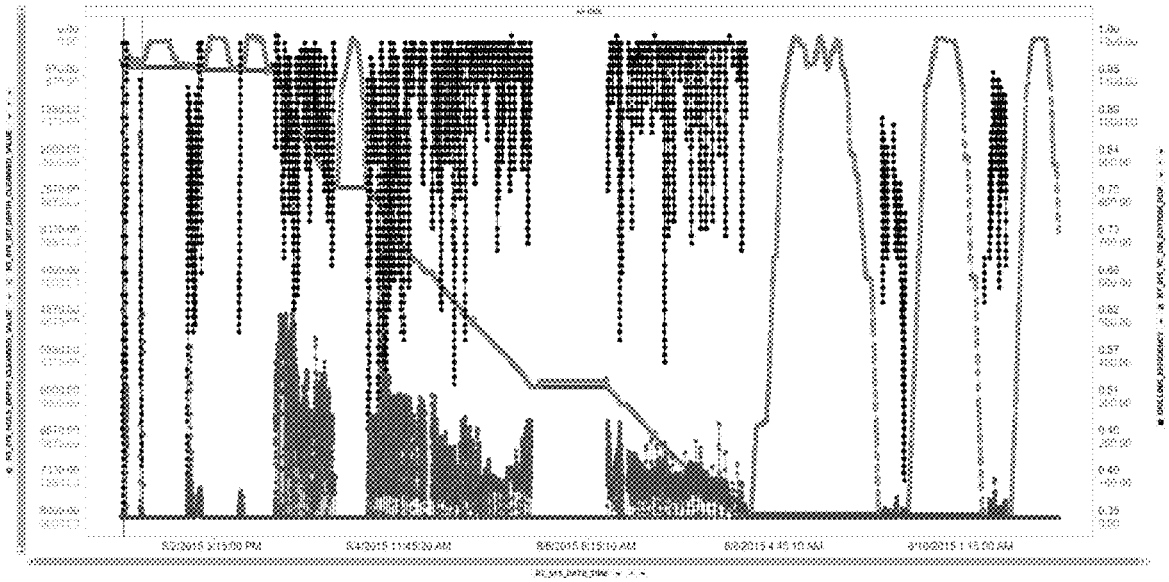
FIG. 9 illustrates an example of a user interface for a drilling optimization system in accordance with the present invention.

Referring now to FIG. 9, an example user interface 900 is illustrated. User interface 900 may provide instantaneous positive feedback regarding drilling parameter change recommendations made in accordance with the present invention. Interface 900 may help improve driller skill with minimal oversight from supervisors. The indicator may be integrated into existing driller screens and may be used to track drilling dysfunctions such as axial, lateral and/or torsional vibration, bit balling, bit bounce, etc.

Figure 10:
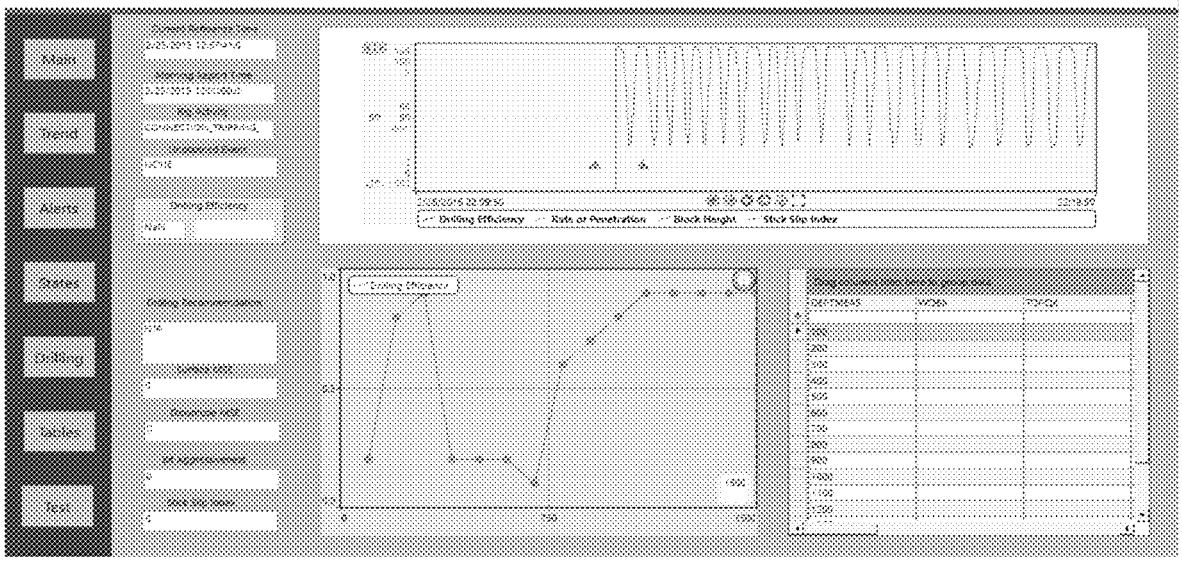
FIG. 10 illustrates a further example of a user interface for a drilling optimization system in accordance with the present invention.

FIG. 10 depicts a further example of a user interface 1000 depicting drilling efficiency. A Bayesian network in accordance with the present invention, such as the example depicted in FIG. 8, may provide a real-time determination of drilling efficiency or inefficiency, such as may be displayed using user interface 1000. The drilling efficiency may be depicted as compared to the depth summary. This information may be used to generate daily reports and to benchmark drilling parameters for various depths and geological formations. The goal of providing drilling efficiency/inefficiency data may be to improve driller skills, to set benchmarks for drilling in conjunction with internal knowledge, and to prevent a drill bit and/or mud motor failure.

Figure 11:
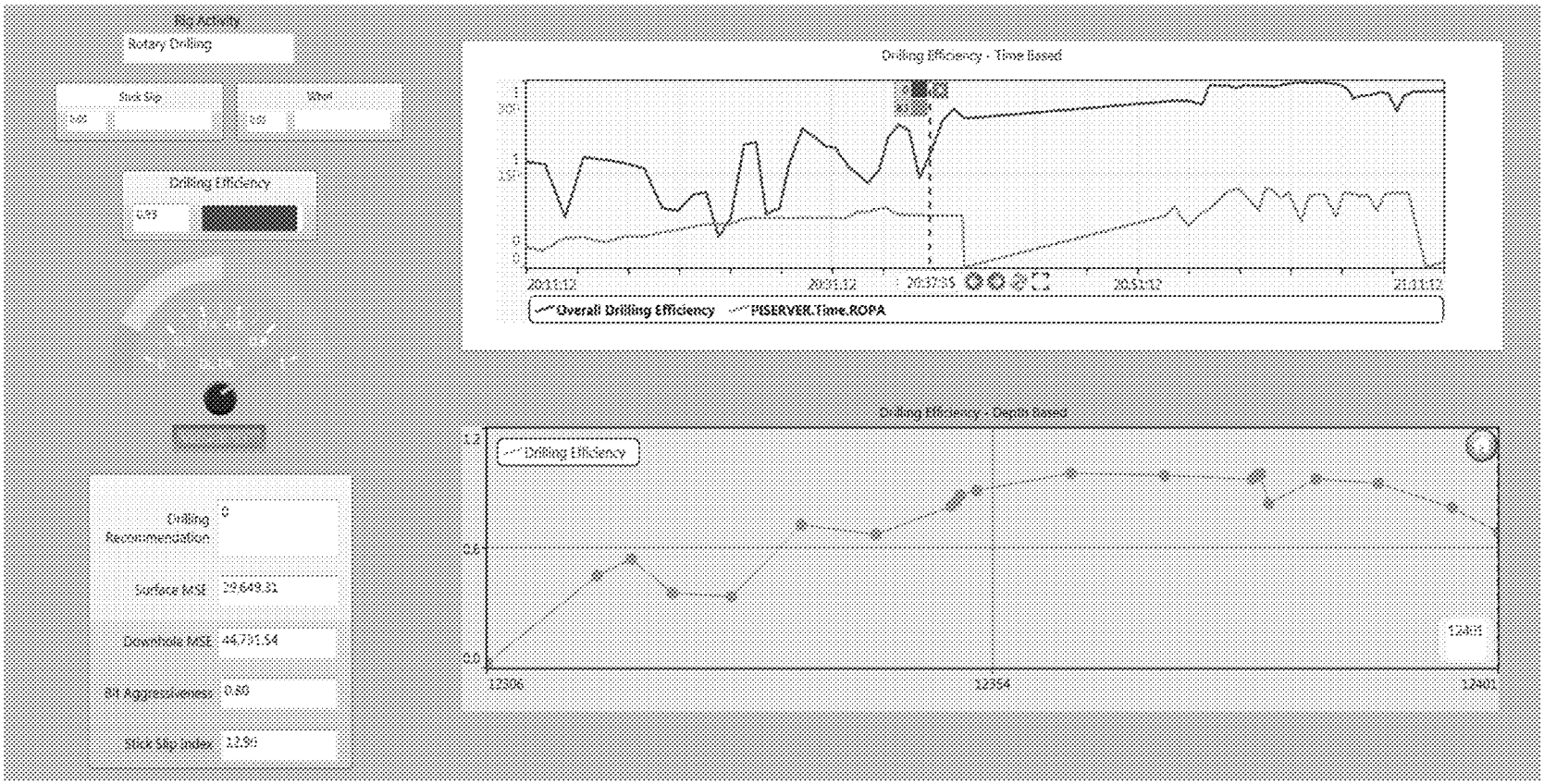
FIG. 11 illustrates an example of an output display dashboard that may be used to depict drilling efficiency or inefficiency to an operator in accordance with the present invention.

Referring now to FIG. 11, an example of an output display dashboard 1100 that may be used to depict drilling efficiency or inefficiency to an operator is illustrated. As can be seen in the example of FIG. 11, simple graphical indications may be provided to illustrate the efficiency, or inefficiency, of drilling operations and may provide opportunities for a driller to improve the drilling efficiency.

The present invention may provide a drilling optimization index with a dial indicator ranging from 0 to 1, or between any other two values, with drilling recommendations provided if the optimization index falls below a predetermined threshold. The drilling optimization index calculations in accordance with the present invention may comprise instantaneous values and trends of real-time drilling sensor data. The real-time drilling sensor data used in accordance with the present invention may comprise, for example, torque, speed, WOB, real-time drilling metrics such as MSE, bit aggressiveness, and stick-slip alarm magnitude, and data from offset wells, such as optimal drilling rates, formation strength, and the like.

Instantaneous values and trends may be used to compute probabilistic location and movement features. The probabilistic outputs of the location and features may be aggregated in a Bayesian network model and used to infer the probability that a certain drilling dysfunction is occurring. Examples of drilling dysfunctions that may be represented are stick-slip, whirl, bit bounce, auto-driller dysfunction, etc. A drilling optimization index may be inferred as the probability that no drilling dysfunction is occurring and may be directly correlated to the efficiency of drilling operations.

Figure 12:
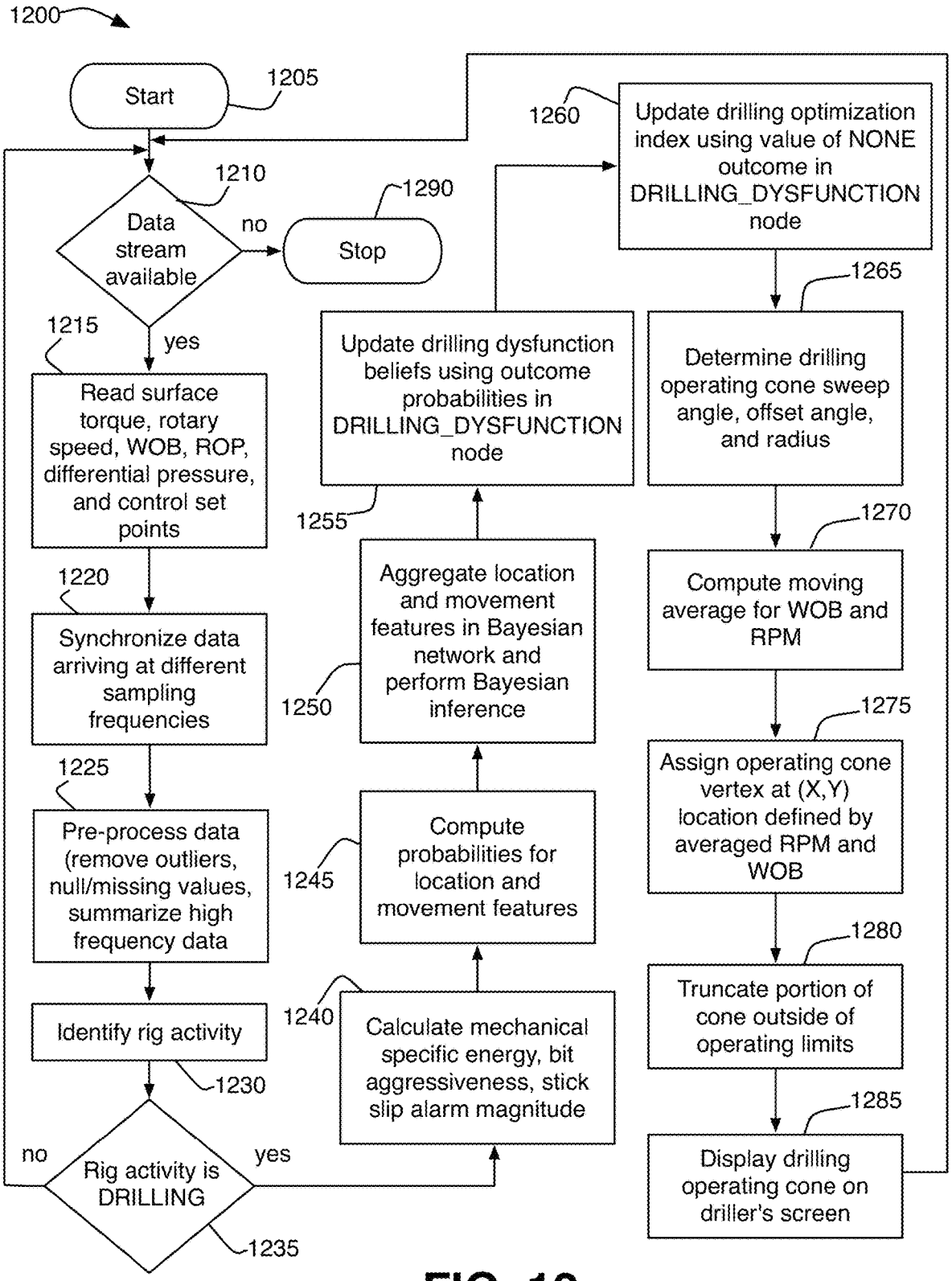
FIG. 12 illustrates an exemplary method in accordance with the present invention for analyzing drilling performance and suggesting adjustments to drilling parameters for improved drilling performance using a drilling cone.

FIG. 12 depicts an example of a method 1200 in accordance with the present invention for analyzing drilling performance and suggesting adjustments to drilling parameters for improved drilling performance using a drilling cone. Method 1200 may start 1205 and proceed to step 1210 to determine whether a data stream is available. A data stream may comprise measurements made by a plurality of sensors measuring ongoing drilling operation parameters. If the conclusion of step 1210 is that no data stream is available, method 1200 may proceed to stop in step 1290. If, however, the data stream is available in step 1210, method 1200 may proceed to step 1215 to read surface torque, rotary speed, weight on bit, rate of penetration, differential pressure, toolface angle, and control set points. Method 1200 may then proceed to step 1220 to synchronize data arriving at different sampling frequencies. Step 1220 may accommodate a situation where different rig sensors read and/or report data at different frequencies, thereby permitting the time synchronization of the sensor measurements to accurately depict the trends of the data collected by various sensors as a function of time.

Method 1200 may then proceed to step 1225 to preprocess the data collected from the sensors. Preprocessing step 1225 may remove obvious data outliers, null or missing values from sensor readings, and/or to summarize high-frequency data to one or a few data points. High frequency data may occur when a particular sensor makes considerably more frequent readings/reports than other sensors.

Method 1200 may then proceed to step 1230 to identify rig activity. Method 1200 may then proceed to step 1235 and, if the rig activity is not drilling, method 1200 may then return to step 1210 to determine whether a drilling data stream is available. If, however, the outcome of step 1235 is to determine that rig activity is drilling, method 1200 may proceed to step 1240. Step 1240 may calculate the mechanical specific energy (MSE), bit aggressiveness, and/or stick slip alarm magnitude using the collected sensor readings. Method 1200 may then proceed to step 1245 to compute probabilities for a set of relevant location and movement features of the drilling rig. Method 1200 may then proceed to step 1250 to aggregate location and movement features in a holistic Bayesian network and perform a Bayesian inference using the probabilistic weights connecting various nodes in the Bayesian network model.

Method 1200 may then proceed to step 1255 to update drilling dysfunction beliefs using outcome probabilities produced by a drilling dysfunction node in the Bayesian network model, described more fully below. Method 1200 may then proceed to step 1260 to update drilling optimization indexes using the probabilistic outcome of the drilling dysfunction node corresponding to no dysfunction detected.

Method 1200 may then proceed to step 1265 to calculate the sweep angle, offset angle and radius for the drilling operating cone. The values calculated in step 1265 may vary depending on the type of dysfunction (stick-slip, whirl, bit bounce, etc.), and the value of the drilling optimization index. An example of a method for performing such calculations is presented in FIG. 13 and is described more fully below. Method 1200 may then proceed to step 1270 where a moving average is computed for the WOB and RPM readings. Method 1200 may then proceed to step 1275 where the moving averages calculated in step 1270 are used to define the x and y coordinates of the drilling operating cone vertex. The x coordinate corresponds to the averaged RPM, while they coordinate is given by the averaged WOB. Method 1200 may then proceed to step 1280 to check for the RPM-WOB operating limits and truncate any part of the operating cone which lies outside of these limits. Method 1200 may then proceed to step 1285 to display the resulting operating cone on the driller's screen/graphical user interface. Graphical depictions of the drilling operating cone are shown in FIG. 14. Once the cone is displayed, method 1200 may return to step 1210 to check for a new data stream and repeat method 1200.

Figure 13:
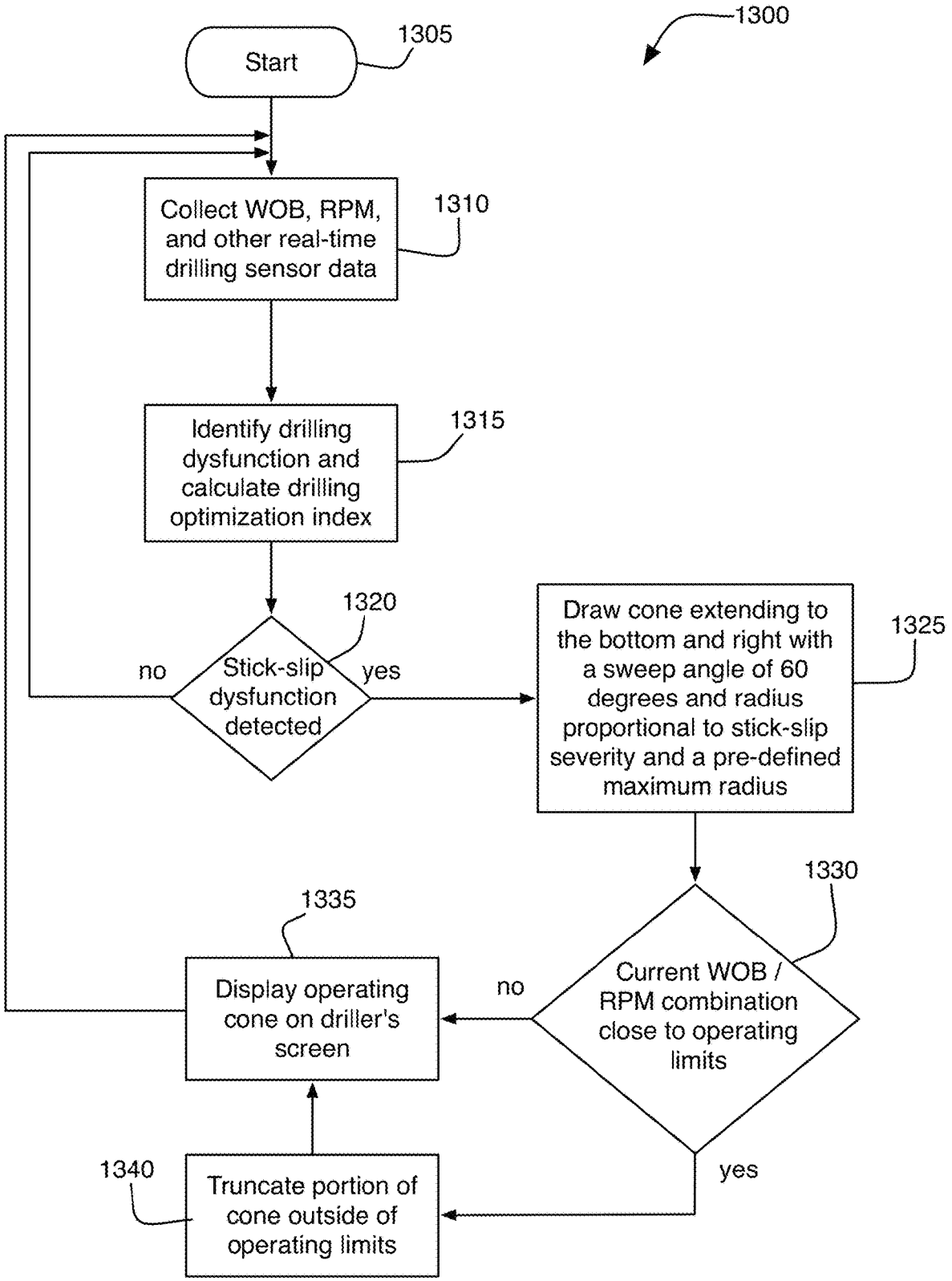
FIG. 13 illustrates an exemplary method in accordance with the present invention for determining a drilling cone for optimization of a drilling operation experiencing a stick-slip dysfunction.
Figure 14:
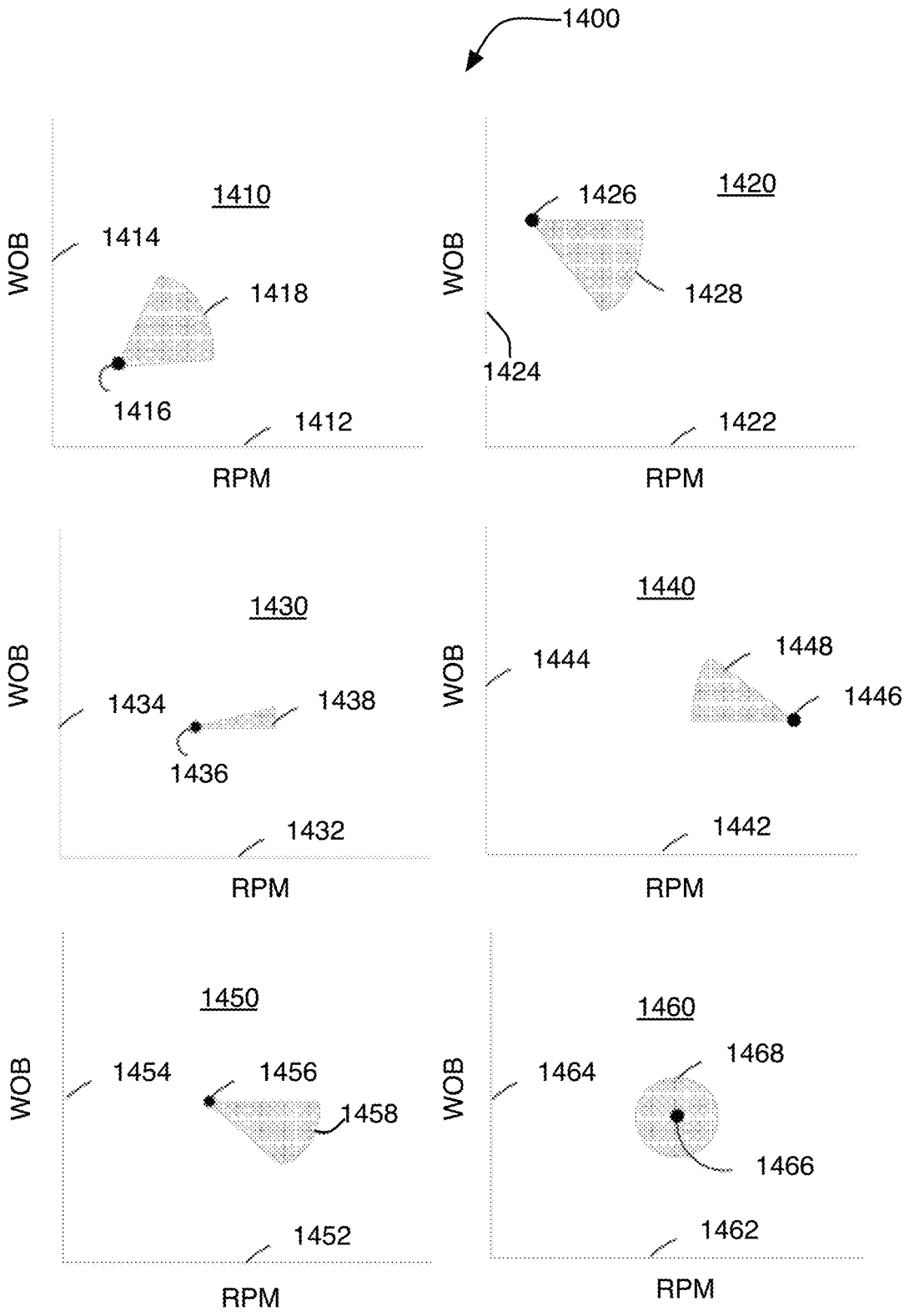
FIG. 14 illustrates exemplary graphical depictions of example drilling operating cones for various possible operational scenarios.

FIG. 13 demonstrates an example of a drilling cone determination method 1300 in accordance with the present invention for optimization of a drilling operation experiencing a stick-slip dysfunction. The method 1300 starts at step 1305 by collecting the real-time WOB, RPM, and other sensor data at step 1310. It then proceeds to step 1315 where the drilling dysfunction and drilling optimization index are determined based on the method presented in FIG. 12. It then proceeds to check at step 1320 whether a stick-slip dysfunction is detected. If the outcome of step 1320 is no, the method 1300 returns to step 1310 to collect new data points. If the outcome of step 1320 is yes, indicating that stick-slip is present in the system, the method 1300 proceeds to step 1325 where it draws a cone toward the bottom and right on the RPM-WOB surface. The cone sweep angle is defined as 60 degrees and its radius is scaled proportionally to the stick-slip severity and a pre-defined maximum radius. For instance, if the maximum radius is defined as 10 units, a stick-slip belief of 0.5 may suggest a cone radius of 5 units, whereas a belief of 0.9 may correspond to a radius of 9 units.

Method 1300 may then proceed to step 1330 where the WOB and RPM values are compared to the operating limits of the drilling process. These limits can be obtained from computational models, look-up tables, drilling equipment manufacturer specifications, etc. If step 1330 determines that the WOB and RPM parameters are within the allowable limits, the method 1300 proceeds to step 1335 which is displaying the cone as computed in step 1325 onto the driller's screen/graphical user interface. If the outcome of step 1330 is that the WOB and/or RPM exceed the allowable limits, the portion of the cone which lies outside the limits is truncated at step 1340, and the cone is re-drawn before being returning to step 1335 to display it on the driller's screen/graphical user interface. Once the cone is displayed, method 1300 may return to step 1310 to check for a new data stream and repeat the entire process. Similar methods to compute the drilling cone may be defined for other drilling dysfunctions, such as whirl, bit bounce, bit balling, low ROP, etc., and also for the case where the drilling optimization index is good.

FIG. 14 illustrates several graphical depictions 1400 of exemplary drilling operating cones for various possible operational scenarios. Each of these scenarios has different root causes and result in different operating cone orientations and/or sizes.

Plot 1410 shows an exemplary case where the drilling optimization index is reduced due to a low ROP dysfunction. This is exemplified by an operating point 1416 toward the lower left corner of the space determined by the RPM axis 1412 and the WOB axis 1414. The suggested operating cone 1418 is generated by moving up and to the right, which corresponds to increasing RPM and maintaining or increasing WOB.

Plot 1420 shows an exemplary case where the drilling optimization index is reduced due to a stick-slip dysfunction. This is exemplified by an operating point 1426 toward the upper left corner of the space determined by the RPM axis 1422 and the WOB axis 1424. The suggested operating cone 1428 is generated by moving down and to the right, which corresponds to increasing RPM and maintaining or decreasing WOB.

Plot 1430 shows an exemplary case where the drilling optimization index is reduced due to a bit bounce dysfunction. This is exemplified by an operating point 1436 located at a critical RPM location in the space determined by the RPM axis 1432 and the WOB axis 1434. The suggested operating cone 1438 is generated by moving toward the right initially, corresponding to increasing RPM while maintaining WOB, and then anti-clockwise if the dysfunction persists.

Plot 1440 shows an exemplary case where the drilling optimization index is reduced due to a whirl dysfunction. This is exemplified by an operating point 1446 located toward the right in the space determined by the RPM axis 1442 and the WOB axis 1444. The suggested operating cone 1438 is generated by moving upwards and to the left, which corresponds to decreasing RPM and maintaining or increasing WOB.

Plot 1450 shows an exemplary case where the drilling optimization index is reduced due to a bit balling dysfunction. This is exemplified by an operating point 1456 at an arbitrary location in the space determined by the RPM axis 1452 and the WOB axis 1454. The suggested operating cone 1458 is generated by moving to the right and down, corresponding to increasing RPM and maintaining or decreasing WOB. This operating cone is quite similar to the one generated for a stick-slip dysfunction 1428, the difference being that the sweep angle is lower.

Finally, plot 1460 shows an exemplary case where the drilling optimization index is good and no dysfunction is observed. This is exemplified by an operating point 1466 located near the center of the space determined by the RPM axis 1462 and the WOB axis 1464. In the present example, the suggested operating cone 1468 is a circle centered at the operating point 1466, corresponding to maintaining RPM and WOB within a range around the current RPM and WOB. In other examples, the suggested operating cone may comprise a circle, an ellipse or other closed curve surrounding the operating point.

While described in examples herein, systems and methods in accordance with the present invention may use different sensor measurements than those described herein. Further, systems and methods in accordance with the present invention may identify different sources and types of drilling inefficiencies than those described herein. While one example of a Bayesian network that may be used in accordance with the present invention is described in examples herein, other Bayesian networks may additionally/alternatively be used in systems and methods in accordance with the present invention. Systems and methods in accordance with the present invention may be used to optimize a wide variety of drilling operations.

Systems and methods in accordance with the present invention may be implemented using one or more computer processor executing computer readable code embodied in a non-transitory format to cause the computer processor to execute methods in accordance with the present invention. Measurements from sensors used in the Bayesian network model may be made using a variety of sensors in addition to and/or instead of those described in examples herein. Those sensors may communicate the measurements they make to the processor(s) using any communication protocol, over a wired or wireless medium.

The invention claimed is:

1. A method to optimize the operations of a drilling rig, the drilling rig having an automated control system, the method comprising:

associating at least one sensor with the drilling rig;

receiving measurements describing the real-time operation of the drilling rig from the at least one sensor, the measurements associated with at least one of a surface torque, a rotary speed, a weight on bit, a rate of penetration, differential pressure, toolface angle, and control set points;

computing, using a processor, location and movement features for the drilling rig based upon the received measurements;

aggregating the location and movement features into a Bayesian network and performing a Bayesian inference, the Bayesian network having a node representative of drilling dysfunction;

updating drilling dysfunction beliefs using the probabilistic outcomes of the node of the Bayesian network representative of drilling dysfunction;

updating a drilling optimization index using the probabilistic outcomes of the node of the Bayesian network representative of drilling dysfunction; and if the drilling optimization index value is below a predefined threshold, providing a recommendation for improving drilling performance;

wherein the automated control system alters operation of a drilling rig device based on the drilling optimization index.

2. The method to optimize the operations of a drilling rig of claim 1, further comprising, after receiving measurements describing the real-time operation of the drilling rig and before computing location and movement features for the drilling rig based upon the received measurements, synchronizing the measurements arriving at different sampling frequencies, removing outliers from the measurements, removing missing and null values from the measurements, and summarizing high frequency measurements.

3. The method to optimize the operations of a drilling rig of claim 2, further comprising, after synchronizing the measurements arriving at different sampling frequencies, removing outliers from the measurements, removing missing and null values from the measurements, and summarizing high frequency measurements and before computing location and movement features for the drilling rig based upon the received measurements, calculating mechanical specific energy, calculating bit aggressiveness, and calculating a stick-slip alarm magnitude.

4. The method to optimize the operations of a drilling rig of claim 1, wherein location features comprise the probability of an attribute being located in relation to a low, normal or high threshold.

5. The method to optimize the operations of a drilling rig of claim 1, wherein movement features comprise the probability of an attribute exhibiting a constant, increasing, decreasing, or erratic trend.

6. The method to optimize the operations of a drilling rig of claim 1, wherein the drilling dysfunctions modeled in the Bayesian network comprise bit balling, bit bounce, stick-slip, whirl, mud motor failure, auto-driller dysfunction, stick-slip controller dysfunction, geo-steering dysfunction, and low rate of penetration.

7. The method to optimize the operations of a drilling rig of claim 1, wherein the recommendations for improving drilling performance comprise increasing or decreasing the rotary speed, weight on bit, differential pressure set point, toolface angle, or a combination of such actions.

8. The method according to claim 1, wherein the recommendations for improving drilling performance include presenting a drilling cone to an operator, the drilling cone expressed as a range of proposed modifications to drilling RPM and weight on bit that may be made to improve drilling performance, and wherein the current RPM and weight on bit correspond to an apex of the drilling cone and the orientation of the drilling cone from the apex depends upon a type of drilling dysfunction detected.

9. The method according to claim 8, wherein the drilling cone presented for detected drilling dysfunction due to low rate of penetration suggests increasing RPM and maintaining or increasing weight on bit, the drilling cone presented for detected drilling dysfunction due to stick-slip suggests increasing RPM while maintaining or decreasing weight on bit, the drilling cone presented for detected drilling dysfunction due to bit bounce suggests increasing RPM, the drilling cone presented for detected drilling dysfunction due to whirl suggests decreasing RPM while maintaining or increasing weight on bit, and the drilling cone presented for detected drilling dysfunction due to bit balling suggests increasing RPM while maintaining or decreasing weight on bit.

10. The method according to claim 9, wherein the drilling cone presented when no drilling dysfunction is detected comprises a predefined range of modifications to RPM and weight on bit surrounding the current RPM and weight on bit.

11. A method to optimize the operations of a drilling rig, the method comprising:

associating at least one sensor with the drilling rig;

receiving measurements describing the real-time operation of the drilling rig from the at least one sensor;

computing, using a processor, location and movement features for the drilling rig using the received measurements;

aggregating the location and movement features into a Bayesian network and performing a Bayesian inference, the Bayesian network having a node representative of drilling dysfunction;

updating drilling dysfunction beliefs using the probabilistic outcomes of the node of the Bayesian network representative of drilling dysfunction;

updating a drilling optimization index using the probabilistic outcomes of the node of the Bayesian network representative of drilling dysfunction;

using the processor to compare the drilling optimization index value to a predefined threshold; and providing a recommendation for improving drilling performance where the drilling optimization index value is below the predefined threshold.

12. The method to optimize the operations of a drilling rig of claim 11, wherein the at least one sensor comprises a first sensor and a second sensor, a sampling frequency of the first sensor being disparate from a sampling frequency of the second sensor.

13. The method to optimize the operations of a drilling rig of claim 12, further comprising synchronizing measurements of the first sensor and the second sensor.

14. The method to optimize the operations of a drilling rig of claim 11, wherein a controller uses the drilling optimization index to alter an operation of the drilling rig.

15. The method to optimize the operations of a drilling rig of claim 11, further comprising displaying a drilling cone on a graphical user interface, the drilling cone including a graphical representation of revolutions per a time period.

16. A method to optimize the operations of a drilling rig, the method comprising:

associating at least one sensor with the drilling rig;

receiving measurements describing the real-time operation of the drilling rig from the at least one sensor;

computing, using a processor, location and movement features for the drilling rig using the received measurements;

aggregating the location and movement features into a Bayesian network, the Bayesian network having a node representative of drilling dysfunction;

updating drilling dysfunction beliefs using probabilistic outcomes of the node of the Bayesian network representative of drilling dysfunction; and updating a drilling optimization index using the probabilistic outcomes of the node of the Bayesian network representative of drilling dysfunction;

wherein, a controller alters operation of the drilling rig, the altered operation associated with the drilling optimization index value.

* * * * *